United States Patent [19]

Ritzerfeld

[11] 4,129,073

[45] Dec. 12, 1978

[54] DUPLICATOR MACHINE WITH MEANS FOR APPLYING TO THE COPIES DIFFERENT MARKINGS

[76] Inventor: Gerhard Ritzerfeld, Schorlemer Allee 14, 1000 Berlin 33, Fed. Rep. of Germany

[21] Appl. No.: 830,441

[22] Filed: Sep. 6, 1977

Related U.S. Application Data

[63] Continuation of Ser. No. 641,019, Dec. 15, 1975, abandoned.

[30] Foreign Application Priority Data

Dec. 20, 1974 [DE] Fed. Rep. of Germany ..... 2461048

[51] Int. Cl.[2] ..... B41F 7/00

[52] U.S. Cl. ..... 101/2; 101/130; 235/465; 235/469

[58] Field of Search ..... 101/2, 45, 90, 91, 93.11, 101/93.12, 130–132.5, 135, 136, 426, 171, 173, 174, 233, 93.24; 235/61.9 R, 61.9 A, 465, 469, 494

[56] References Cited

U.S. PATENT DOCUMENTS

| | | | |
|---|---|---|---|
| 2,772,048 | 11/1956 | Collison et al. | 101/93.24 X |
| 2,952,204 | 9/1960 | Sherman | 101/93.24 X |
| 2,976,803 | 3/1961 | Van Marle | 101/2 X |
| 2,988,984 | 6/1961 | Eckert, Jr. et al. | 101/2 |
| 3,066,798 | 12/1962 | Toulmin, Jr. | 235/469 X |
| 3,233,538 | 2/1966 | Ritzerfeld et al. | 101/132.5 X |
| 3,283,701 | 11/1966 | Ritzerfeld | 101/90 X |
| 3,470,357 | 9/1969 | Ritzerfeld et al. | 235/494 X |
| 3,599,773 | 8/1971 | Serracchioli | 101/93.24 X |
| 3,603,253 | 9/1971 | Tonkin | 101/132.5 X |
| 3,616,749 | 11/1971 | Ritzerfeld | 101/90 X |
| 3,632,995 | 1/1972 | Wilson | 235/494 |
| 3,650,204 | 3/1972 | Burger et al. | 101/2 |
| 3,667,382 | 6/1972 | Kaplan | 101/90 X |
| 3,683,803 | 8/1972 | Gray et al. | 101/132 |
| 3,761,700 | 9/1973 | Patel et al. | 235/465 X |
| 3,798,421 | 3/1974 | Gilberg et al. | 235/465 X |
| 3,894,217 | 7/1975 | Ebukuro et al. | 235/469 |
| 3,938,088 | 2/1976 | Clark | 235/469 X |
| 4,009,466 | 2/1977 | Clark | 235/469 |

*Primary Examiner*—E. H. Eickholt
*Attorney, Agent, or Firm*—Michael J. Striker

[57] ABSTRACT

A duplicator machine is operative for making copies of originals, printing forms, and the like, in whole-page, paragraphwise and sectionwise modes of operation. The copies made are intended for different uses and or destinations, for example for handling by different clerical departments and/or sections of a factory. The duplicator machine is provided with means for applying routing markings, the marking means being located in the path of travel of copies passing through the duplicator machine upstream of the delivery station to the end of such path. The marking means applies to the copies distinguishable routing markings respectively indicative of different purposes or destinations for the copies being made. Within the path of travel of the copies through the duplicator machine, the routing markings are applied either downstream or upstream of the location at which the information on the original or printing form to be copied is actually applied to the copying material.

29 Claims, 14 Drawing Figures

18
19
20
21
22
23
24
25
26
27
28
29
30
31
57
58
59
60
61
62
63
64
65
66
67
68
69
70
71
72
73
74
75
76
77
78
79
80
81
82
83
84
85
86

DUPLICATOR MACHINE WITH MEANS FOR APPLYING TO THE COPIES DIFFERENT MARKINGS

This is a continuation of application Ser. No. 641,019, filed Dec. 15, 1975 and now abandoned.

BACKGROUND OF THE INVENTION

The invention relates to duplicator machines and copying machines, particularly those capable of copying or printing in whole-page, paragraphwise and sectionwise modes of operation, onto sheets of paper, cards, slips, tickets or the like.

In clerical work-preparing procedures, it is for example known to imprint upon slips of paper already bearing certain printed information further information derived from an original, or the like, by means of a duplicator machine. For example, it is known to insert a multi-line customer order page into a copying machine. The customer order page may consist of a list of items to be produced for a customer order, each line specifying the type of item and the number of such items to be produced for the customer, and other such information. The copying machine then makes a plurality of copies of such customer order. The copies may be of the entire customer order page, or instead successive lines of the customer order may be copied onto successive copies. These copies are then used for various purposes. The copies may be sent to different factory sections respectively charged with the manufacture of the types of items on the successive copies. Alternatively, if the plurality of copies made from an original are all identical, they may be sent to different clerical departments, such as the billing department, the inventory department, the personnel supervision department, the cost accounting department, etc.

Various ways are known for expeditiously routing such copies. For example, the sheets of papers, cards, or the like, which are fed into the copying machine may from the start bear printed information such as "for the billing department", "for the inventory department", "for the personnel supervision department", etc. Alternatively, the sheets of papers, cards, or the like which are fed into the copying machine may be entirely blank but be of different colors, so that the billing department receives the yellow copies, the inventory department the blue copies, and so forth.

Such a breakdown of copies is an outgrowth, in part, of the previous use in industry of mainfold carbon-paper packets containing a set of preprinted blank forms on differently colored sheets, with the first sheet being filled in with handwriting or by typewriter, the packet disassembled, and the differently colored copies then properly routed. Often, with such carbon-paper packets, certain ones of the differently colored copies had blacked-out portions so arranged that some of the information entered onto the top sheet of the packet would not become entered onto some or all of the differently colored copies.

A problem with such carbon-paper packets is that often the number of differently colored copies required exceeded the number of copies which could be produced using multiple layers of carbon paper, so that the last copies in the packet would be very faint or altogether illegible. Accordingly, more and more, interest is turning to the aforedescribed use of duplicators and copying machines for making the requisite copies.

However, a serious problem exists when the copies are made using duplicator machines. If the different copies are to be made on differently colored and/or differently pre-printed forms, then it is necessary to feed the differently colored, or otherwise differing forms into the duplicator machine in the proper sequence. Likewise, a sufficient supply of the differently colored, or otherwise differing sheets must be kept on hand at all times. It is in particular the feeding of the differently colored, or otherwise differing forms into the machine which presents the greatest problem.

It is known to employ a plurality of cooperating sheet-feeding units, operating one after the other in cyclical fashion for feeding into the duplicator machine sheets of different successive colors, for example.

However, the need for a plurality of cooperating and coordinated sheet-feeding units, and the necessity for keeping separate supplies of the differently colored, or otherwise differing sheets, slips, tickets, cards, or the like, is inconvenient and costly. Moreover, with the known sequencing techniques, if there is a misfeed or nonfeed of a sheet of one color, or one characteristic, there may be a loss of coordination in the color code sequence which may persist undetected for a time long enough to cause considerable clerical confusion thereafter.

SUMMARY OF THE INVENTION

It is accordingly a general object of the invention to feed the sheets, etc., intended for different uses or destinations in so simple a way as to virtually eliminate past problems involving complicated sequencing procedures.

This object, and others which will become more understandable from the description, below, of preferred embodiments, can be met, according to one advantageous concept of the invention, by arranging in the duplicator machine itself, in the path of travel of the copies, either upstream or downstream of the location at which the copying material receives the imprint of the original or printing form to be copied, marking means for providing the successive copies with appropriate routing markings. These routing markings are indicative of the intended uses or intended destinations for the successive copies.

Thus, as a simple example, assume that a particular clerical department makes, for each bill, a white original and three copies, one on yellow paper, the second on blue paper, and the third on green paper. The original would be fed to the duplicator machine. Instead of feeding into the duplicator machine a yellow sheet, followed by a blue sheet, followed by a green sheet, one would simply feed in three white sheets. Then, as the copies pass through the interior of the duplicating machine, marking means located in the path of travel of the copies would provide the first copy with a large yellow stripe, the second copy with a large blue stripe, and the third copy with a large green stripe. When the three copies are deposited at the delivery station at the outlet of the machine, they will be as conspicuously different from each other as if they were printed on yellow, blue and green sheets of paper, respectively, and clerical handling can proceed in the already established manner. The making of these three colored stripes in the aforementioned sequence can be effected automatically, for example if due to high volume the duplicator machine can be reserved for the making of only a single type of copies, i.e., always one yellow, one blue and one green copy of a white original of a bill. Alternatively, the duplicator machine can be provided with a "normal mode" pushbutton, which the user activates to cause the yellow, blue and green stripes to be applied in the aforedescribed manner, but with additional pushbuttons also being provided for non-automatically selecting the color of the stripe to be applied to each successive copy. This would be necessary, for example, if the blue copy is accidentally destroyed and another blue copy needed, or if a special set of colored copies is required for a particular purpose, or if in general so many different color-coded set-ups are to be handled by a particular duplicator machine that there actually is no "normal mode" of operation in the particular clerical department in question.

The different routing markings indicate the intended purpose or destination for the copies. For example, they may indicate that different copies are to go to different departments, different persons in a single department, to one and the same department at different times (for example to the billing department before and after delivery of goods to a customer), and so forth.

The routing markings need not be distinguishable by color, or by color alone. They can be simple markings, such as large dots or stripes, numbers, perforations, entire sentences or paragraphs providing instructions relative to what should be done with the copy, or any combination of the foregoing.

In very large organizations, the number and type of copies required may be very large, and the breakdown of the copies extremely complicated. For example, the original to be copied may contain many items, different ones of which are to be copied onto successive copies, successive groups of copies, individual copies alternating with groups of copies, and the like. The selective copying of only certain items can be performed for example using a masking arrangement which is shiftable over the original in a stepwise fashion under the control of an intermittent-advancement mechanism. Furthermore, the duplicator machine may be provided with a plurality of blank formats, for example different headings printed on a transparent strip located superimposed upon the original to be copied; the different headings may include paragraphs reciting contractual provisions which are to be applied to those copies which constitute order acknowledgements to be sent customers but not on those copies which are intended for purely internal use; likewise, the different headings may include instructions to clerical personnel which are not to appear on order acknowledgements to be sent customers; etc. When a large number of copies are to be made from different sections of the original, with various sections of the original being copied in conjunction with different superimposed headings, form lay-outs, form paragraphs, and the like, then the coordination of the distinguishable routing markings, the advancement of the masks for the originals, and the advancement of the transparent strip bearing the form paragraphs and the like, become too complicated to be controlled by the average employee using pushbuttons on the control panel of the duplicator machine. Under such circumstances, it is more appropriate to have available a set of perforated program cards or perforated tapes, with convenient identification numbers. The operator of the machine, knowing what the situation involved is, knows to insert perforated program card #7 into the machine, and then merely inserts the original into the machine. Automatic means thereafter sees to it that the correct numbers and kinds of copies are made.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 7*b* depicts in greater detail one of the preselector counters of FIG. 7*a.

DESCRIPTION OF THE PREFERRED EMBODIMENTS

Figure 1:
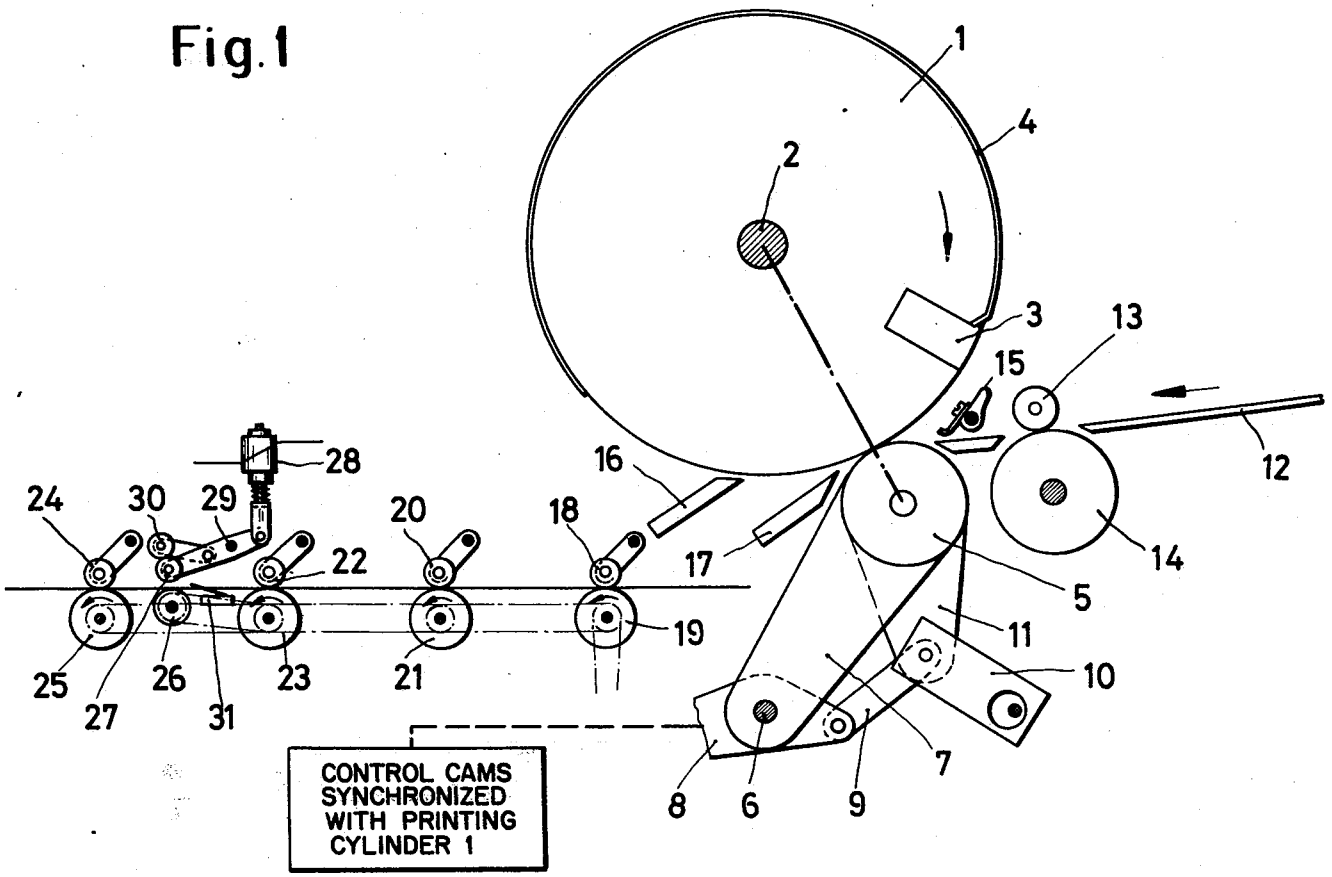
FIG. 1 depicts a rotary duplicator machine provided with marking means according to the invention.

FIG. 1 schematically depicts a rotary duplicator machine comprised of a printing cylinder 1 rotatably mounted on a shaft 2 and provided with a clamping arrangement 3 for holding a printing form 4 in place on the drum. The duplicator machine further includes a counterpressure element 5 swingable into a position bearing against printing cylinder 1. Counterpressure element 5 is mounted at its axial ends on mounting levers 7 which in turn are mounted for rotation about a shaft 6. In per se conventional manner, control cams ccs rotating in synchronism with printing cylinder 1 cause the lever linkage 8, 9, 10, 11 to swing the counterpressure element 5 into and out of engagement with the printing cylinder 1. The individual slips of paper (or cards, tickets or sheets) to be printed upon are all of identical shape and size. They are placed upon infeed table 12, and transported by infeed cylinders 13, 14 through the gap intermediate printing cylinder 1 and counterpressure element 5. A retaining spring 15 serves to properly hold the slip located intermediate the printing cylinder and the counterpressure element at those times when the counterpressure element is in swung-away or disengaged condition, so that the slip will not be further moved during the travel past of the portion of the printing form 4 off of which an image is not to be taken.

After printing the desired information onto the slip of paper, the latter is guided by guide elements 16, 17 into a path of travel which extends between successive pairs of transport rollers 18 and 19, 20 and 21, 22 and 23, and 24 and 25 and ends in a non-illustrated delivery station. Also located in the path of travel of the slip are a plurality of driven transport rollers 26. The driven transport rollers 26 have axes extending normal to the picture plane, and they are arranged one behind the other. Also provided is a corresponding plurality of rubber-surfaced inking cylinders 27. Each inking cylinder 27 can be moved into or out of engagement with the associated driven transport roller 26. Associated with each inking cylinder 27 is an electromagnet 28. When one such electromagnet 28 is energized, the associated inking cylinder 27 swings about a shaft 29 into the path of the travelling slip of paper and into a position pressing against the associated transport roller 26.

The electromagnets 28, which likewise are arranged one behind the other extending normal into the picture plane, are individually energizable, so that the inking cylinders 27 can be brought into contact with the slip to be printed upon either individually or in any desired combination. Each inking cylinder 27 is in contact with a respective one of a plurality of felt-covered ink-applying cylinders 30. Each ink-applying cylinder 30 stores the ink to be used for a relatively long time interval and applies a certain amount of ink to the associated inking cylinder 27 during each rotation of the latter. The individual ink-applying cylinders 30 hold ink of different respective colors, so that each inking cylinder 27 can imprint a different color onto the travelling slip of paper. Accordingly, depending upon which electromagnets 28 are energized, a slip travelling intermediate the inking cylinders 27 and the transport cylinders 26 will be caused to bear no ink stripe, one ink stripe of a selected color or a plurality of ink stripes of one or more colors in any desired combination.

In this way, the individual slips can be clearly marked in correspondence to their intended use. Upstream of the inking cylinders 27 in the path of travel of the slips is located a sensor 31 which detects the leading edge of each slip and in response to such detection closes a switch in the common current supply line of all the electromagnets 28. As a result, the electromagnets previously selected for energization by means of a preselecting arrangement will not actually become energized until the slip to be marked arrives at a location immediately upstream of the inking cylinders 27. The preselecting arrangement, at its simplest, could consist of a set of switches, each associated with one of the electromagnets 28.

Instead of inking cylinders 27, use could be made of printing cylinders bearing mirror images of the printed image, or other markings, to be transferred, with the printing cylinders being operative for printing upon the slips, markings, or the like, corresponding to the intended uses of the slips. The various impressions can be made in various colors, if and as desired. However, in selecting the inks to be used for providing markings on the slips, it is necessary to make sure that these be compatible with and visible over the ink transferred onto the slip from the printing form 4.

Figure 1A:
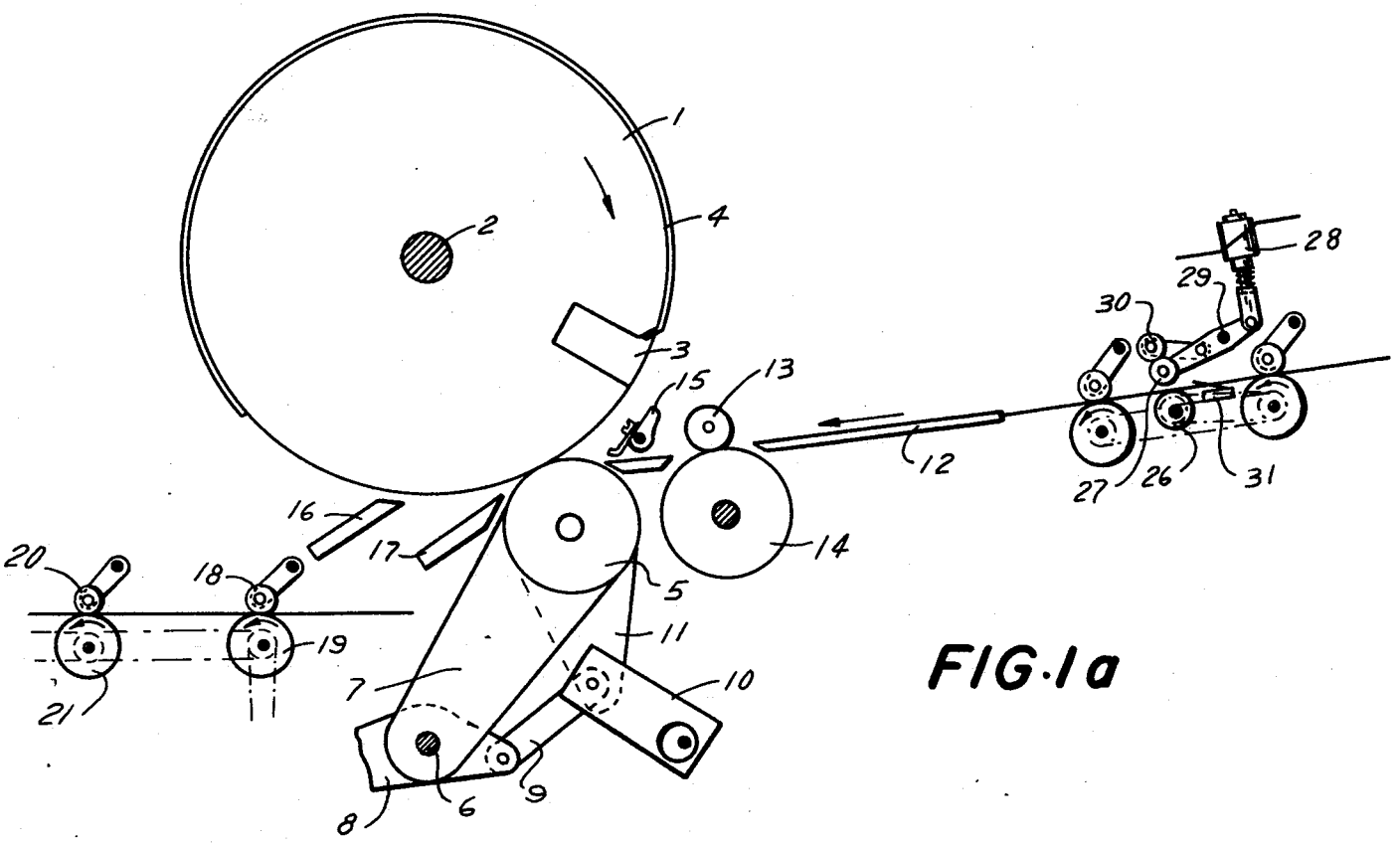
FIG. 1*a* depicts the same machine depicted in FIG. 1, but with the marking arrangement located upstream of the printing or copying station.

FIG. 1*a* depicts the machine of FIG. 1, but with the marking arrangement located upstream of the copying or printing station.

Figure 2A:
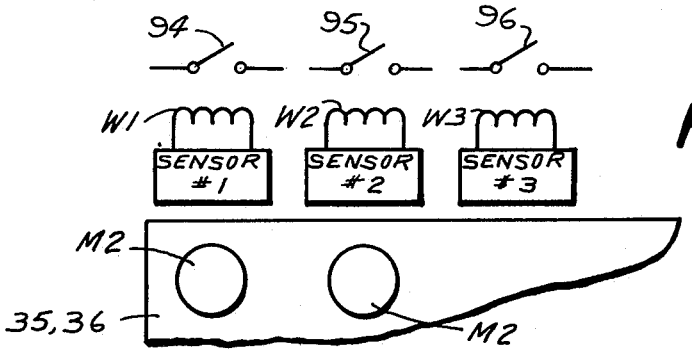
FIG. 2*a* depicts the control of the marking arrangement by control markings provided on the original and/or mask to be copied in FIG. 2.
Figure 2:
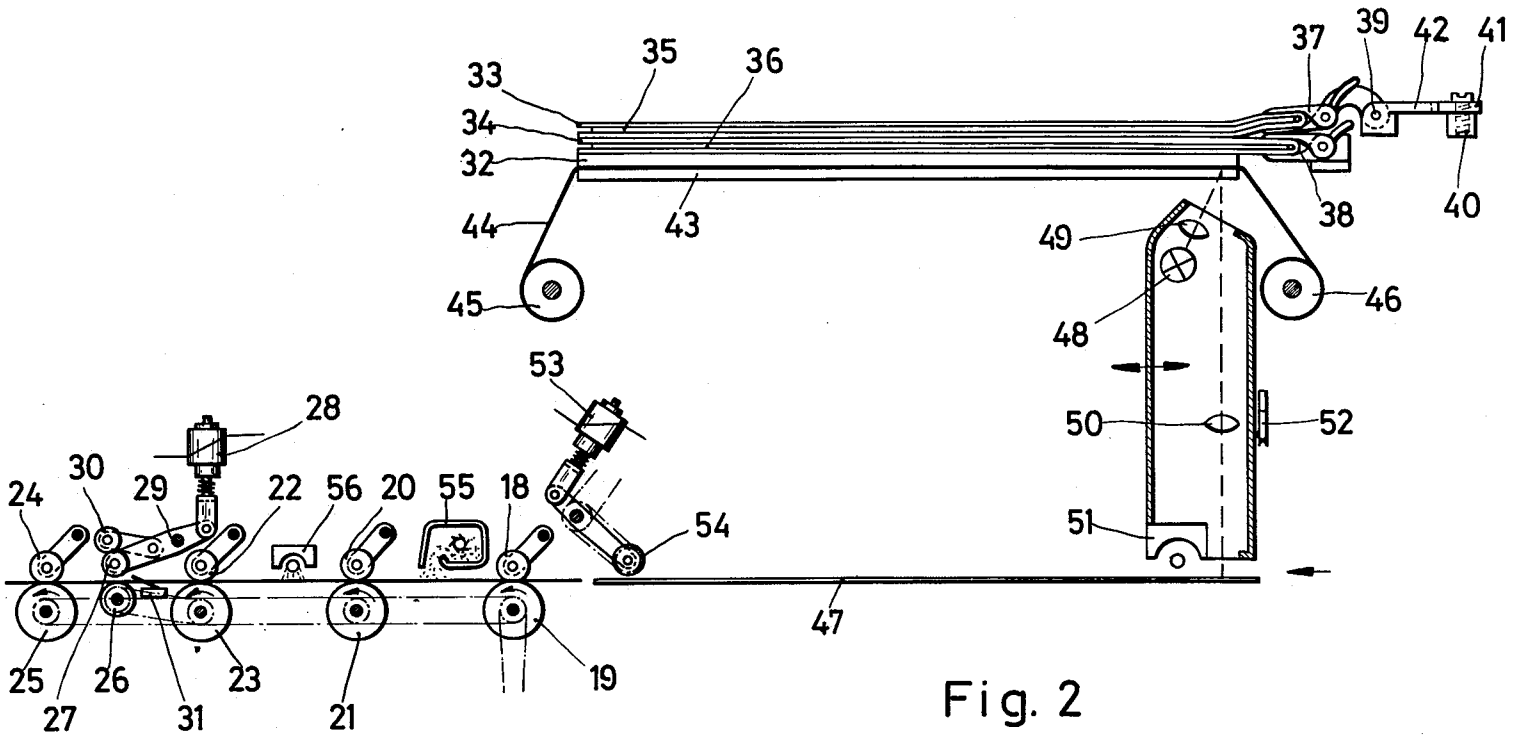
FIG. 2 depicts an electrostatic copying machine provided with marking means according to the invention.

FIG. 2 is a schematic depiction of an electrostatic copying device. The device includes a transparent support member 32 on which are supported two transparent plastic jackets 33 and 34 containing originals 35 to be copied and blank or printed masks 36. The plastic jackets 33 and 34 are secured in holding arrangements 37, 38 shiftable in direction normal to the plane of FIG. 2. This makes it possible to bring the originals and blank or printed masks into any desired relative position, so as to be able to copy only selected sections of the originals. The upper holding arrangement 37 is pivotably mounted on a shaft 39. Holding arrangement 37 is stepwise advanced by means of an intermittent-advancement member 41 pivotally mounted on a shaft 39. Holding arrangement 37 is stepwise advanced by means of an intermittent-advancement member 41 pivotally mounted on a shaft 40. Intermittent-advancement member 41 engages a rack 42 connected with the holding arrangement 37.

Located beneath and parallel to the transparent support member 32 is a transparent plate 43. Intermediate transparent member 32 and transparent plate 43 there is shiftably arranged a transparent foil strip 44 held to both sides of support surface 32 by means of reels 45 and 46. Foil strip 44 bears a plurality of form images arranged one next to the other, proceeding in the direction of shiftability of the foil strip; these form images may for example be rows of numbers or symbols having meaning to bookkeeping or inventory personnel, or could be legible form paragraphs containing warnings or instructions to readers. By appropriately shifting the foil strip 44, a selected one of these form images can be brought into a properly registered position relative to the original, or portion of the original, to be copied, and accordingly be copied along with the latter.

Arranged below foil strip 44 and the originals 35 is a copying paper 47, for example a zinc oxide paper, onto which is to be projected the preselected form image on foil strip 44 together with the unmasked portions of the original or originals. The copying paper 47 is fed from the right, as indicated by the arrow and, after being electrostatically charged and then exposed, is transported further in the same direction. The exposure is performed by means of an illumination arrangement located shiftable in the plane of the Figure and located intermediate the support surface 32 and the foil strip 44, on the one hand, and the copying paper 47, on the other hand. The illumination arrangement is comprised of a light source 48 and two lenses 49, 50. Connected to and cooperating with this arrangement is an electrostatic charging arrangement 51 operative for electrostatically charging successive portions of the copying paper 47 as each is just about to be exposed to light. Those charged portions of copying paper 47 which become exposed to the light become discharged to an extent corresponding to their exposure, thereby resulting in the formation of an electrostatic latent image. Thereafter, the latent-image-bearing copying paper 47 is dusted with ink powder, which adheres only to the electrostatically charged portions. The powder image is then fixed, in a conventional manner. A limit switch 52 serves to limit the extent of the return or retraction movement of the exposing arrangement.

After the charging and exposure of the copying paper 47 has been performed, an electromagnet 53 is energized, thereby causing a transport cylinder 54 to engage the copying paper 47 and feed the latter to the pair of transport rollers 18, 19. Located downstream of the latter, in substantially the same way as in FIG. 1, are additional pairs of transport rollers 20, 21 and 22, 23 and 24, 25. Located intermediate rollers 22, 23 on the one hand and rollers 24, 25 on the other hand is the marking arrangement 26–31. Also provided is a powder applying arrangement 55 and a fixing arrangement 56.

Instead of the just-described electrostatic copying technique, it would also be possible to transfer a mirror image of the form image on foil strip 44 and of the images on the originals onto a closed selenium band travelling in a loop. Such looped band would be charged prior to exposure and in the aforedescribed manner becomes discharged in correspondence to the exposure. The selenium band would then be fed past a powder-applying station, with a powder image forming on the now only partially charged band portions. The powder image on the travelling band would then be transferred, in per se known manner, onto a sheet of copying paper, and then fixed. Thereafter, the copy would be marked in correspondence to its intended use.

Figure 3:
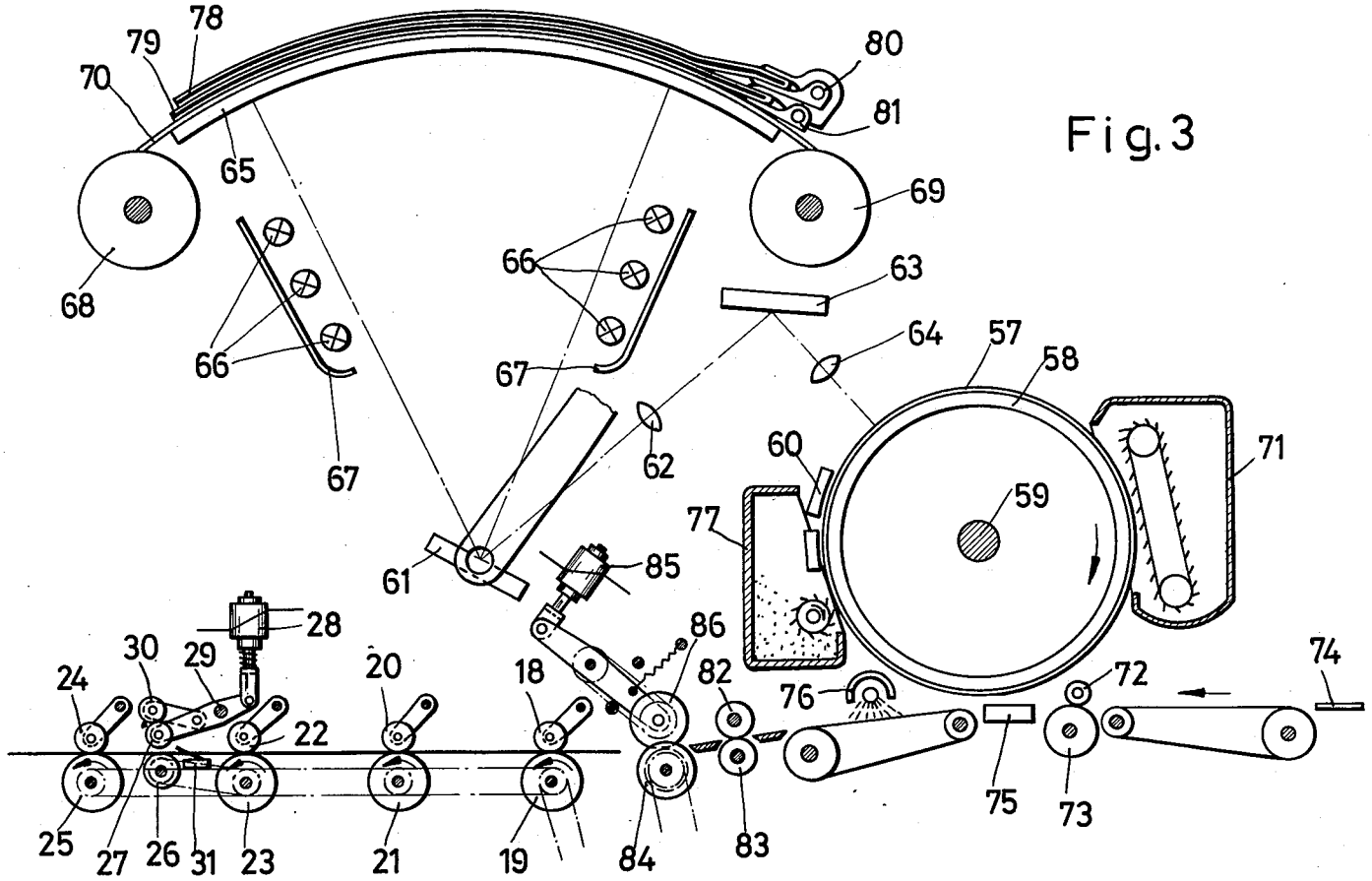
FIG. 3 depicts a xerographic copying machine provided with marking means according to the invention.

FIG. 3 depicts the arrangement of the transport rollers 18–25 and the marking arrangement 26–31 in conjunction with a xerographic copying apparatus. The latter includes a drum 58 having a selenium coating 57 and rotated about a shaft 59 by means of a non-illustrated drive. Arranged at the outer periphery of drum 58 is a charging arrangement 60 which extends over the full axial length of the drum. Charging arrangement 60 electrostatically charges the successive drum surface portions which move past it. A pivoting mirror 61, optics 62, a non-moving mirror 63 and further optics 64 cooperate in per se known manner to project onto the selenium layer 57 a mirror image of the original supported by the transparent support member 65. The illumination of the originals is performed by means of lamps 66 and cooperating back reflectors 67.

The pivoting mirror 61 turns in synchronism with the rotation of drum 58 and projects onto the selenium layer 57 an image of both the form image carried by a transparent foil strip 70 shiftably held by reels 68, 69 as well as an image of the unmasked portions of the originals. Those portions of the selenium layer 57 which have been previously charged are now discharged in correspondence to the amount of light to which they are exposed, so as to form an electrostatic latent image on the selenium layer 57. As the drum 53 continues to turn, the portion of the layer 57 bearing a latent image moves into the powder-applying station 71 and powder is applied to the selenium layer. However, the powder adheres only to the charged portions of the layer. A slip of paper 74 fed into the infeed rollers 72, 73 is moved past the drum 58 during the proper time interval and, with the cooperation of a discharging arrangement 75, the powder image on the selenium layer 57 is transferred onto the slip 74. Thereafter, the slip 74, bearing the image now in non-mirror-image form, moves into a fixing station at which the powder image is fused by means of an infrared heater 76. Residual powder on the selenium layer 57 is removed at a cleaning station 77 before the layer is recharged.

The originals and the masks are arranged, with their printed sides facing the support member 65, inside transparent jackets 78 and 79. Jackets 78, 79 are in turn secured at the edge of the transparent support member 65 and extend over the full length of the latter (normal to the plane of the Figure). The jackets 78, 79 are thusly secured by means of clamping arrangements 80, 81 which are mounted for longitudinal shifting. For example, if a mask consisting of a blank sheet with a horizontal slit is placed in the lower jacket and the upper jacket contains a sheet with a series of printed lines, relative shifting of the two jackets in longitudinal direction will result in the unmasking of successive ones of the printed lines.

The slip 74, now bearing the fixed image of the printing on the originals and foil, is fed by transport rollers 82, 83 to a set of cutting devices. Each cutting device includes a lower cutting member 84, here a cutting wheel 84 mounted for rotation about a stationary axis, and an upper cutting member 86, here a cutting wheel 86 mounted for rotation at the end of a lever whose position is controlled by an electromagnet 85. It will be understood that the cutting devices of the set are arranged one behind the other, with the cutting device shown in FIG. 3 blocking from view those behind it. Each cutting device is operative when activated for cutting along a cut line which extends in the direction of travel of the slip. By activating different ones of the electromagnets 85, it is possible to subdivide a slip into a plurality of slips, or to trim a slip to impart to it a desired smaller size. Thereafter, the marking of the slips occurs in the manner described with respect to other embodiments.

Figure 4:
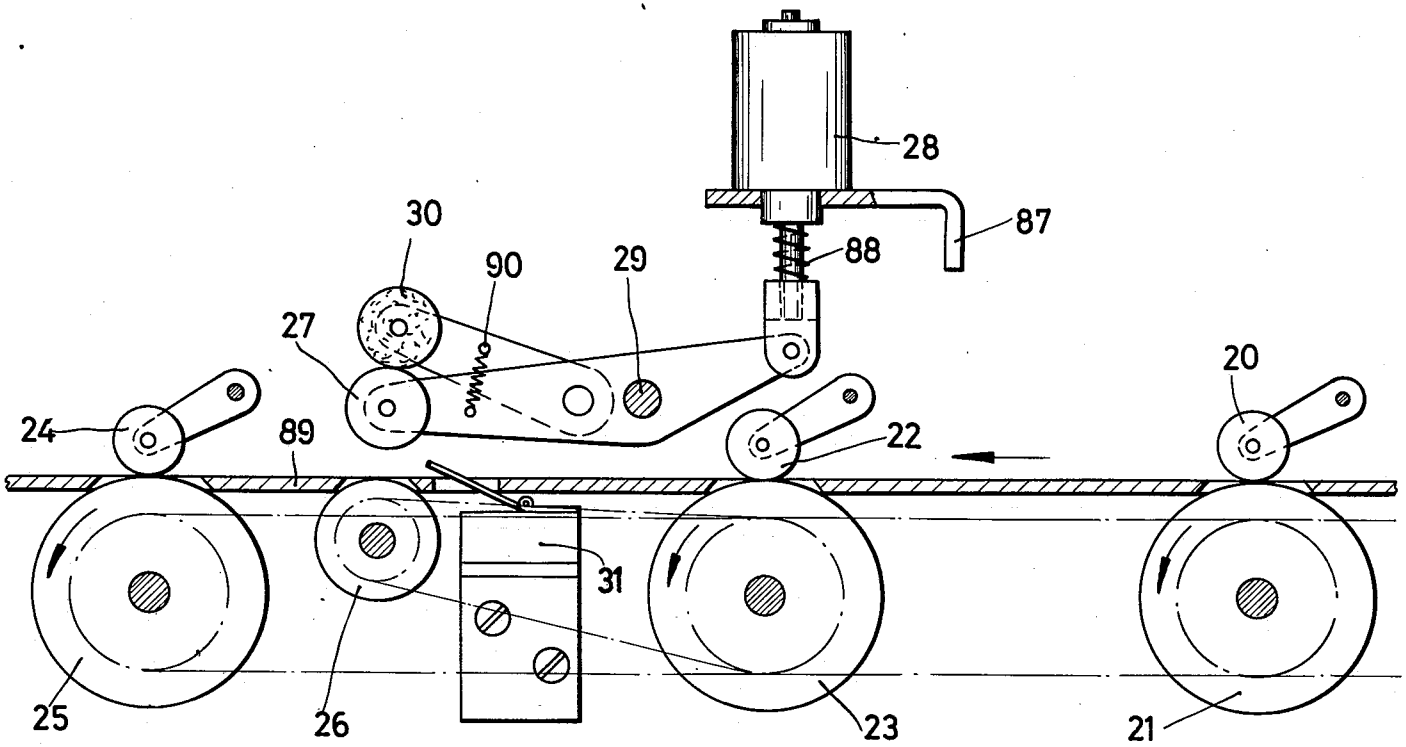
FIG. 4 depicts details of the marking means.

FIG. 4 depicts the marking arrangement of FIGS. 1–3 on an enlarged scale. The electromagnet 28 is mounted on a stationary support 87 and acts against the opposition of a spring 88. When electromagnet 28 is not energized, spring 88 lifts inking cylinder 27 up from the path 89 for the cards or slips. The close contact between inking cylinder 27 and ink-applying cylinder 30 is effected by means of a biasing spring 90.

Figure 5:
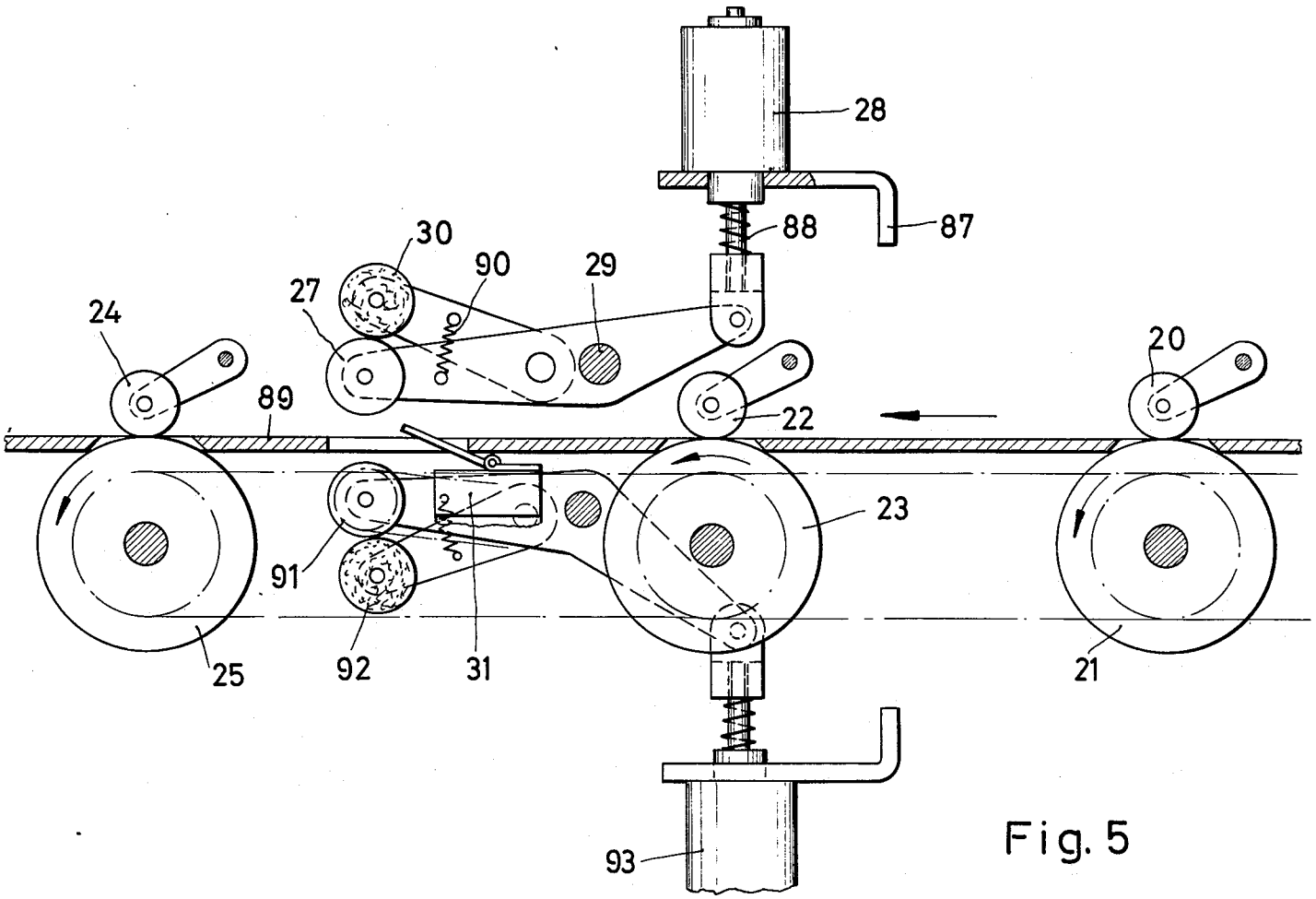
FIG. 5 depicts details of another version of the marking means.

FIG. 5 depicts a marking arrangement so designed as to be capable of printing markings on both sides of the travelling slips. Accordingly, beneath the support 89 for the travelling slips there is arranged means for marking the bottom sides of the slips. These means include a plurality of inking cylinders 91, arranged one behind the other like inking cylinders 27, and a plurality of ink-applying cylinders 92 arranged one behind the other like ink-applying cylinders 30. A set of electromagnets 92 is provided at the underside of the support 89, for activating individual ones of the inking cylinders 91. The inking cylinders 91 are continuously driven. The control of the electromagnets is performed in such a manner that when one of the electromagnets 28 is energized the associated one of the lower electromagnets 93 is also energized. As a result, the associated two inking cylinders 27 and 91, located directly opposite each other, will be brought into simultaneous engagement with the opposite sides of the slip of paper. When such simultaneous engagement occurs, the lower and constantly driven inking cylinder will cause the corresponding upper inking cylinder 27 to likewise turn.

Figure 1B:
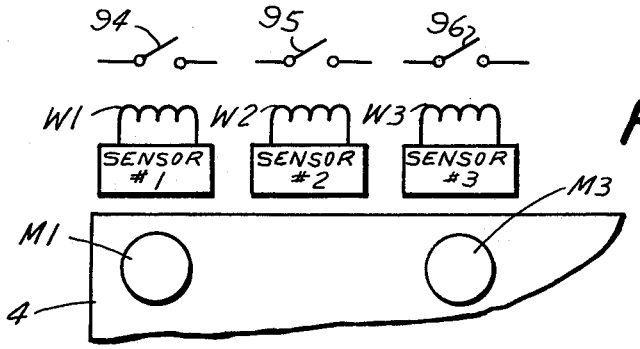
FIG. 1*b* depicts the control of the marking arrangement by control markings provided on the printing form of FIG. 1.
Figure 6A:
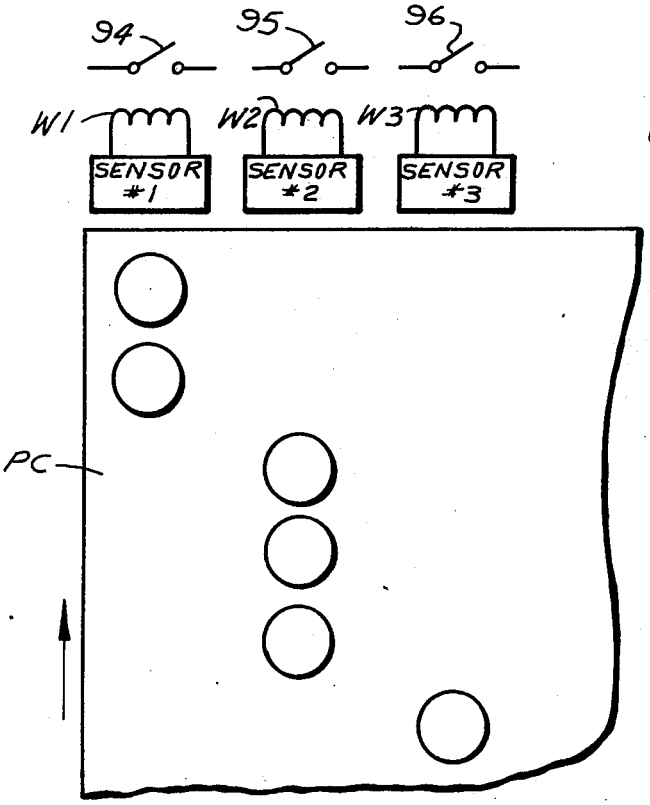
FIG. 6*a* depicts the control of the marking arrangement by control markings provided on a perforated tape or card.
Figure 6:
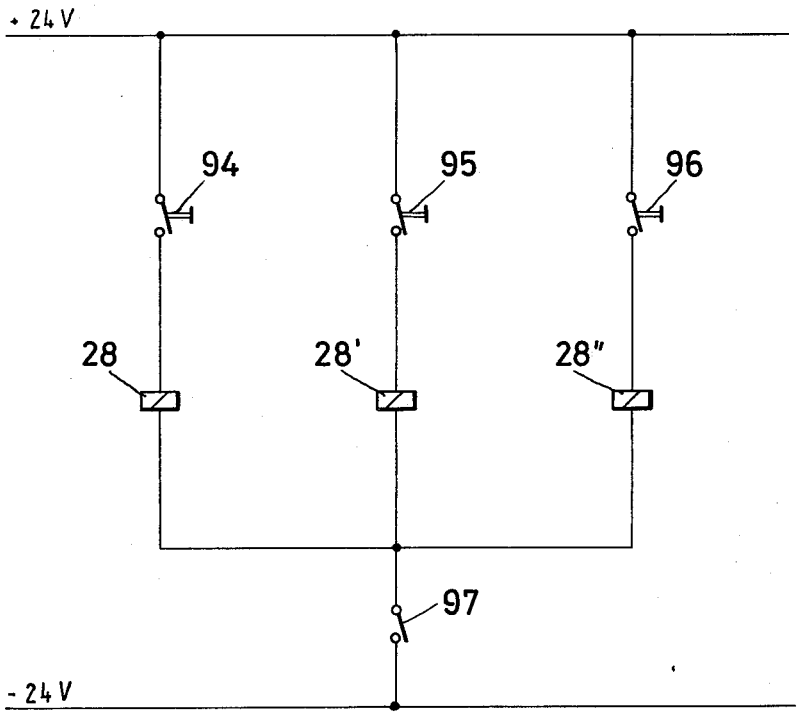
FIG. 6 depicts a circuit for controlling the marking means.

FIG. 6 is a circuit diagram for the control of the individual electromagnets 28, 28′, 28″, etc., of the marking arrangement. Connected in series with each of these electromagnets is a respective one of switches 94, 95, 96. If one of these switches is closed, this energizes the associated electromagnet, provided that the switch 97, connected in the shared common current supply line, is also closed. Switch 97 cooperates with sensor 31 and closes when the leading edge of an advancing slip is sensed. Switches 94, 95, 96 can be manually activated by means of buttons; alternatively they can be activated in response to the automatic reading of information on a program storage, such as a perforated card or tape, or in response to the automatic reading of control markings recorded in an appropriate manner on the printing form or on the original to be copied. The activation of switches 94–96 by control markings M1, M3 on the printing form 4 of FIG. 1 is shown in FIG. 1*b*. Markings M1, M3 are sensed by sensors #1 and #3; here no marking is sensed by sensor #2. Sensors #1 and #3 cause associated relay windings W1, W3 to become energized; windings W1, W3 pull associated switches 94, 96 closed, thereby causing the associated electromagnets 28, 28″ to become energized, effecting the production of two routing marks on each copy produced from form 4. The activation of switches 94, 96 by control markings on the original 35 and mask 36 of FIG. 2 is shown in FIG. 2*a*. The only difference relative to FIG. 1*b* is that the control markings are provided on the original 35 and/or the mask 36. The activation of switches 94–96 by information on a program storage is shown in FIG. 6*a*. Here, the sensors are responsive to control markings on a program carrier PC. In FIG. 6*a*, the first two copies produced will be marked by one marking cylinder, the next three by the next marking cylinder, and the last by the third marking cylinder. The electromagnets, of which there can be as many as desired, can accordingly be energized individually or in any desired combination, and in any desired order.

Figure 7:
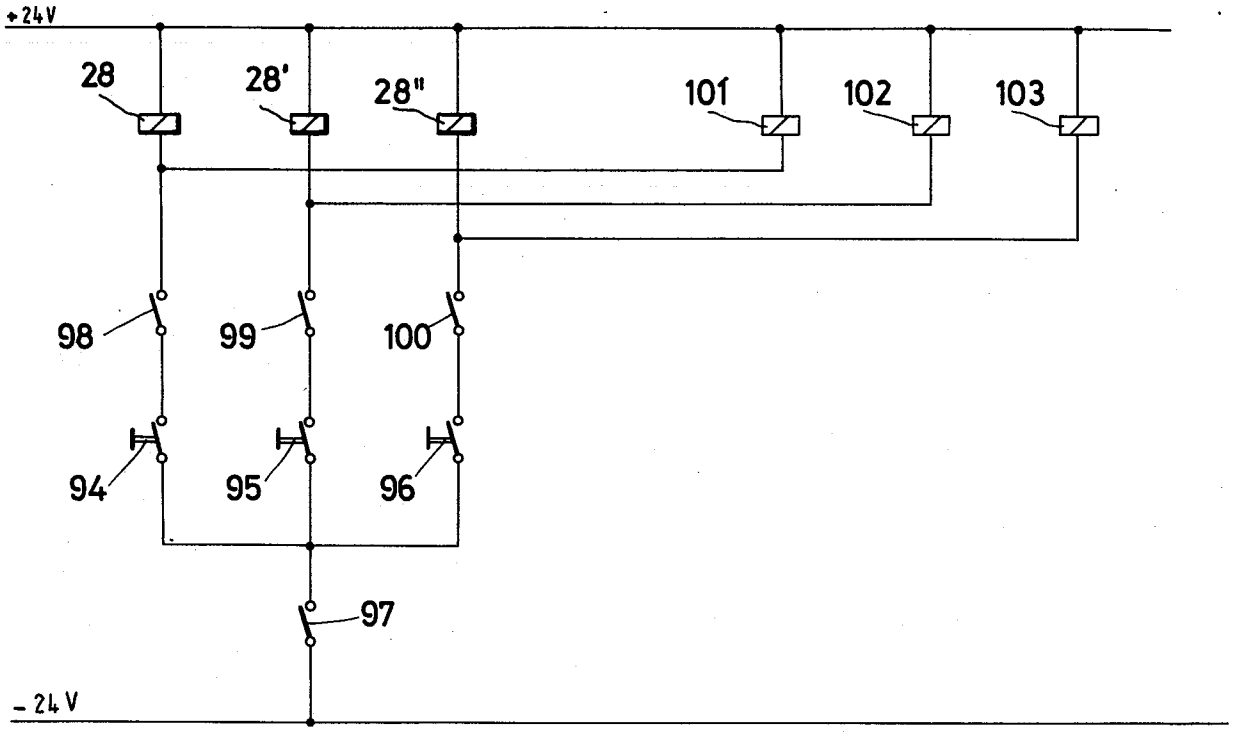
FIG. 7 depicts another circuit for controlling the marking means.

In the circuit depicted in FIG. 7, the aforedescribed switches 94, 95, 96 have connected in series with them further switches 98, 99, 100. Closing of any one of switches 94, 95, 96, whether manually or under automatic program control, does not activate a marking arrangement unless the associated one of switches 98, 99, 100 is also closed.

Figure 7A:
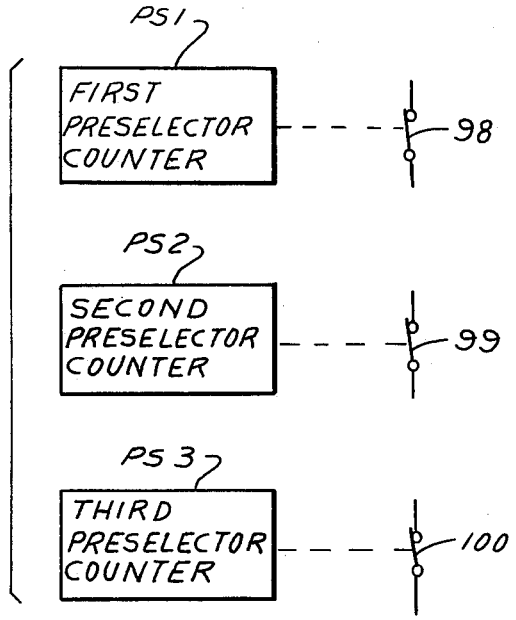
FIG. 7*a* schematically depicts three preselector counters usable in conjunction with the circuit of FIG. 7.

Switches 98, 99, 100 are activated under the control of preselector counters PS1, PS2, PS3, respectively. These are shown in FIG. 7*a*. The first preselector counter PS1 is shown in greater detail in FIG. 7*b*; the second and third preselector counters PS2, PS3 are of the same construction. The preselector counters are used to preselect the number of successive slips which are to be marked in a certain way. The preselector counters can be either backward counters or resettable counters.

Figure 7B:
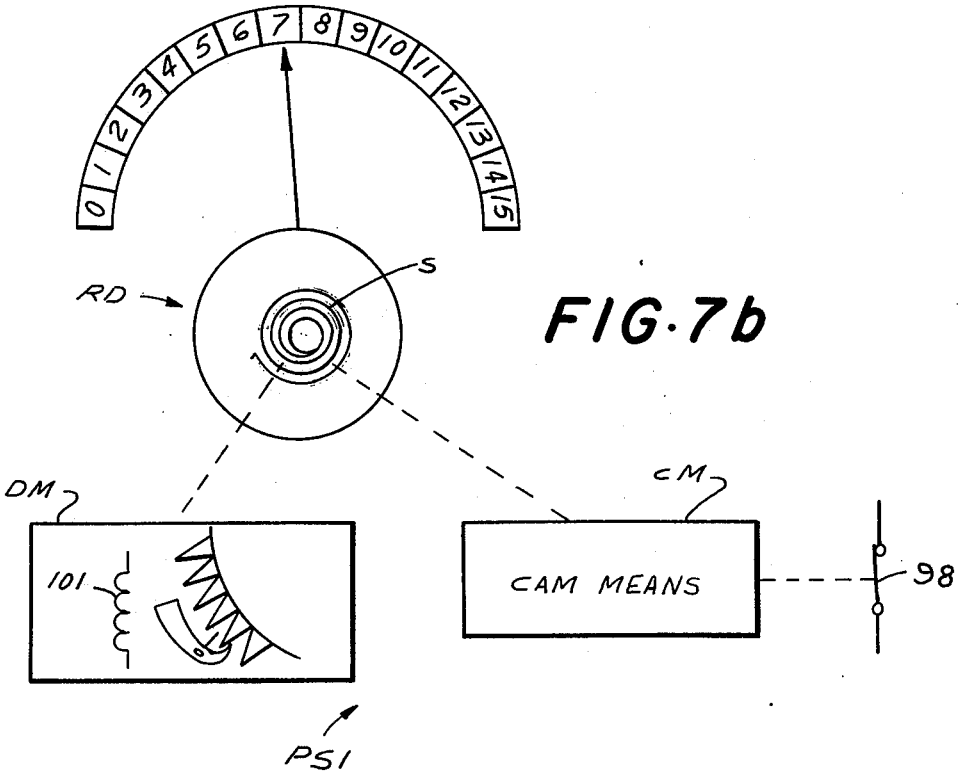

The preselector counters shown in FIGS. 7*a* and 7*b* are electromechanical counters. Each preselector counter PS1–PS3 has a rotary dial RD set-table by the user to a desired number. First preselector counter PS1 is associated with electromagnet 101 and with switch 98. Switch 98 is open only when such preselector counter is at count "zero".

Assume that the operator of the arrangement moves the dial RD of the preselector counter PS1 from the "zero" setting to the "ten" setting. As soon as the dial leaves the "zero" setting, switch 98 closes; this control of the switch in cooperation with the preselector dial is effected very simply by cam means CM or the like. With switch 98 now closed, the operator of the arrangement closes switch 94. It will be assumed that switches 95, 96, 99 and 100 remain uninterruptedly open, for the sake of simplicity. Now, as soon as sensor 31 detects the leading end of a travelling slip, switch 97 closes. Because both switch 94 and switch 98 are closed, electromagnet 28 will be energized, and the associated marking arrangement will print upon the slip in question. Because electromagnet 28 is connected in parallel with electromagnet 101, electromagnet 101 will likewise be energized. Energization of electromagnet 101 will cause the dial of the preselector counter to move from the "ten" setting backward to the "nine" setting, automatically. For example, energization of the electromagnet 101 may release a detent mechanism DM which permits a spring S to drive the dial RD of the preselector counter PS1 backward by one step.

After the slip in question passes by, sensor switch 97 opens again. When the leading edge of the next such slip is detected, switch 97 closes again. Switches 94 and 98 are still closed; it is to be recalled that switch 98 stays closed so long as the dial RD of the associated preselector counter PS1 is not in the "zero" setting. This next slip is printed in the same way as the preceding one, and the dial RD of the preselector counter PS1 is automatically moved by electromagnet 101 from the "nine" setting backward to the "eight" setting.

This continues until nine such slips have been printed. When the tenth slip is sensed, switch 97 closes for the tenth time, the slip is marked in the aforedescribed manner, and the electromagnet 101 causes the dial of the preselector counter to move the "one" setting backward to the "zero" setting. In response, and after the electromagnet 28 has had just enough time to cause a marking operation to be performed, switch 98 opens. Further sensing of slips will not effect marking, because switch 98 will remain open so long as the dial RD of the associated preselector counter PS1 remains in the "zero" setting. If the operator wishes to similarly mark another batch of 10 slips, he must manually move the dial RD of the preselector counter PS1 from the "zero" setting back to the "ten" setting, again. Of course, if he wishes another number of slips to be marked, for example 15, he would move the dial of the preselector counter from the "zero" setting up to the "fifteen" setting.

Switch 99 and associated electromagnet 102 cooperate with the second such preselector counter PS2, whereas switch 100 and associated electromagnet 103 cooperate with the third preselector counter PS3. This makes it possible to establish a variety of combinations of markings to be made and also the number of slips to be so marked.

It will be understood that the above described electromechanical preselector counter is merely exemplary; more typically, use would be made of a completely electronic counting circuit of the type well known in the art, settable in a manner entirely analogous to that just described.

Instead of the just-described type of counter, which counts backward to zero, thereby terminates further marking, and must be reset by the user to the same or a different number of permit further marking to occur, use could alternatively be made of an automatically resettable counter. An automatically resettable counter of the type well known in the art would differ in that when the count "zero" is reached, the user would not have to reset the dial of the counter anew; instead, he would merely press a "reset" button or the like, which would automatically reset the dial to the number which had previously been selected during the preceding countdown, e.g., 10. Again, in actual practice, entirely electronic counters are preferred. Also, it will be appreciated that a very considerable variety of counting techniques and counting means could be used.

Figure 8:
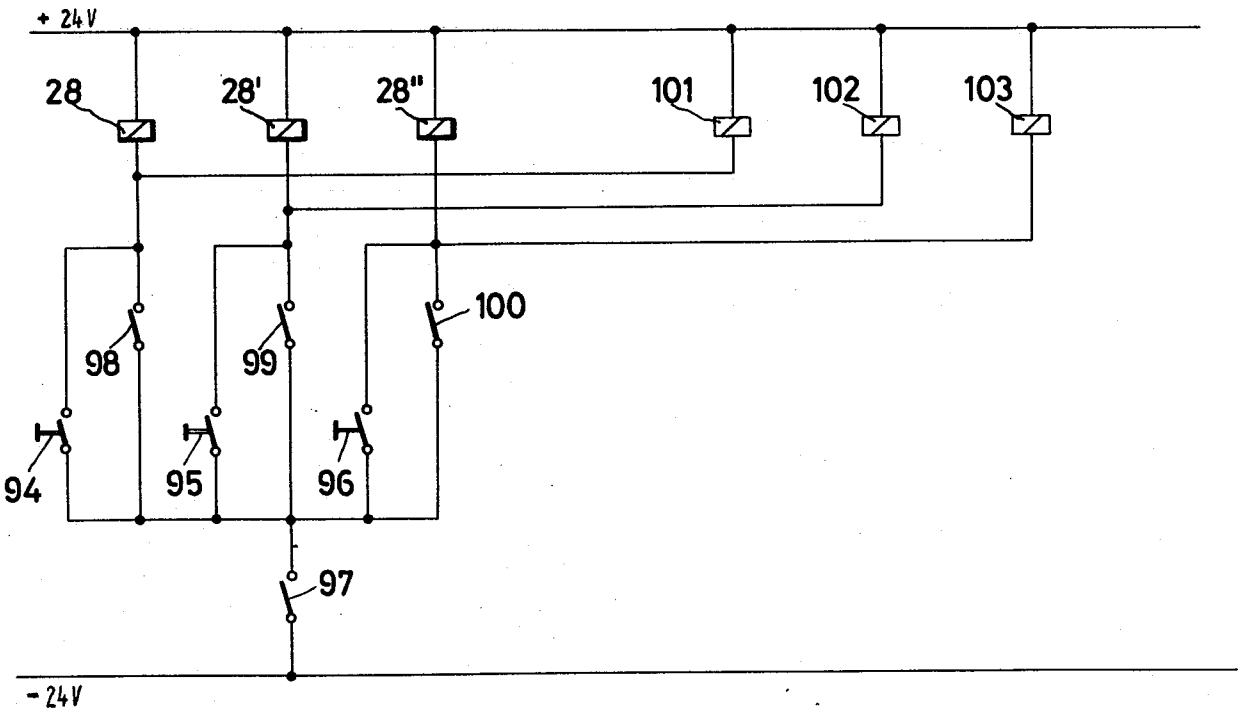
* and FIG. 8 depicts yet another circuit for controlling the marking means.

FIG. 8 depicts a modification of the circuit shown in FIG. 7. In FIG. 8, the switches 98, 99, 100 are arranged in parallel, not in series, to the respective ones of manually activatable switches 94, 95, 96. In FIG. 8 switches 94, 95, 96 are not used to initiate marking operations, as in FIG. 7. Instead, they are used to bypass and/or override the aforedescribed automatic counting operation. To initiate marking operations, other means can be provided, for example a further switch connected in series with switch 97, between the latter and the −24V line.

It will be understood that each of the elements described above, or two or more together, may also find a useful application in other types of circuits and constructions differing from the types described above.

While the invention has been illustrated and described as embodied in an arrangement for making marks of a particular type in duplicating arrangements of particular types, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a duplicator machine of the type operative for whole-page, paragraphwise or sectionwise copying of printing, and the like, on originals, printing forms, and the like, and operative for producing corresponding copies intended to be differently routed, particularly to different clerical departments and the like, the machine being of the type wherein transport means transports the copies through the machine along a predetermined path in a predetermined direction, controllable marking means operative for providing the copies with differently colored routing markings which can be used for distinguishing among the copies as to their purpose and for properly routing the copies, the controllable marking means comprising a plurality of printing cylinders, means for applying to respective ones of the printing cylinders inks of different respective colors which when applied to the copies are visible over the copied information on the copies, and means mounting each printing cylinder for rotation and for swinging movement independently of the other printing cylinders between an inoperative position in which the printing cylinder does not contact the copies and an operative position in which the printing cylinder contacts the copies and rolls upon the surface of the copies producing solid stripes of the respective color extending in said predetermined direction and constituting routing markings.

2. In a machine as defined in claim 1, the machine including a copying station at which the information to be copied is transferred onto the copies, the controllable marking means being arranged in the path of travel of the copies downstream of the copying station.

3. In a machine as defined in claim 1, the machine including a copying station at which the information to be copied is transferred onto the copies, the controllable marking means being arranged in the path of travel of the copies upstream of the copying station.

4. In a machine as defined in claim 1, said controllable marking means including preselecting means for preselecting the type of routing markings to be made upon the copies.

5. In a machine as defined in claim 4, said controllable marking means including preselecting means for preselecting the number of routing markings to be made upon the copies.

6. In a machine as defined in claim 1, said controllable marking means including preselecting means for preselecting the type and number of routing markings to be made upon the copies.

7. In a machine as defined in claim 1, the controllable marking means further comprising moving means for effecting such swinging movement, and means for causing the moving means to effect such swinging movement.

8. In a machine as defined in claim 7, wherein the moving means comprises a set of electromagnetic moving means, one for each printing cylinder, and wherein the means for causing the moving means to effect the swinging movement comprises means for furnishing control signals to the electromagnetic moving means.

9. In a machine as defined in claim 8, wherein the means for furnishing the control signals comprises preselecting means operative for selecting in advance of the making of the copies the different routing markings to be provided on successive copies.

10. In a machine as defined in claim 1, further including synchronizing means for synchronizing the provision of routing marking on the copies with the travel of the copies through the machine.

11. In a machine as defined in claim 10, the synchronizing means comprising means for detecting the leading edges of the copies travelling through the machine.

12. In a machine as defined in claim 11, the means for detecting the leading edges of the copies comprising means for detecting when the leading edge of a copy reaches a predetermined location downstream of the location at which the material to be copied has been copied onto the copy.

13. In a machine as defined in claim 7, the means for causing the moving means to effect the swinging movement of the printing cylinders comprising means for generating and furnishing activating signals to the moving means, the machine further including means for detecting the arrival of copies at a predetermined location just upstream of the printing cylinders, and means for delaying the furnishing of the activating signals to the moving means until the detection of the arrival of a copy at such location.

14. In a machine as defined in claim 1, the controllable marking means including means for selecting the routing markings to be applied to the copies by generating and furnishing to the moving means control signals corresponding to the routing markings to be applied and including means for synchronizing the application of such control signals to the moving means with the arrival of copies at at least one predetermined location in the path of travel of copies travelling through the duplicator machine.

15. In a machine as defined in claim 1, further including means for generating signals indicative of the travel of successive copies through the machine, counter means for counting the signals and thereby keeping track of the number of copies being made at a particular time, and means for controlling the operation of the controllable marking means in dependence upon the operation of the counter means.

16. In a machine as defined in claim 15, the counter means being presettable to different starting counts, and the means for controlling the operation of the marking means in dependence upon the counter means comprising means for terminating the provision of routing markings on successive copies when the counter means reaches a predetermined count.

17. In a machine as defined in claim 15, the counter means being presettable to different final counts, and the means for controlling the operation of the marking means in dependence upon the counter means comprising means for terminating the provision of routing markings on successive copies when the counter means reaches the preselected final count.

18. In a machine as defined in claim 1, further including means for generating signals indicative of the travel of successive copies through the machine, a plurality of counter means for counting the signals and thereby keeping track of the number of copies being made at a particular time, means for controlling the operation of the controllable marking means in dependence upon the operation of the counter means, and means for setting the plurality of counter means independently of each other.

19. In a machine as defined in claim 15, the counter means being a mechanical counting device.

20. In a machine as defined in claim 15, the counter means being an electrical counting device.

21. In a machine as defined in claim 1, further including means for generating and furnishing to the controllable marking means control signals determinative of the operation of the marking means, and sensing means operative for deriving the control signals from the original or printing form being copied.

22. In a machine as defined in claim 8, wherein the means for furnishing the control signals includes program cards or tape bearing optical, magnetic or mechanical markings and means for deriving the control signals from such markings.

23. In a machine as defined in claim 1, the controllable marking means including means operative for providing the copies with distinguishable routing markings on both sides of the copies.

24. In a machine as defined in claim 1, the duplicator machine being a rotary duplicator machine operating on the alcohol image transfer principle, the duplicator machine including means for selecting the portion of an original or printing form to be copied, the duplicator machine including printing elements and dampening means, and the controllable marking means being arranged downstream of the latter in the path of travel of the copies, and the machine further including at least one delivery station for the routing-marking-bearing copies, and further including preselecting means for preselecting the routing markings to be provided on the copies to be made.

25. In a machine as defined in claim 1, the duplicator machine being a lithographic rotary duplicator machine, the duplicator machine including means for selecting the portion of the printing form to be copied, the controllable marking means being located in the path of travel of the copies downstream of the printing elements of the machine, and the duplicator machine further including at least one delivery station for receiving the routing-marking-bearing copies, and further including preselecting means for preselecting the routing markings to be provided by the marking means on the copies to be made.

26. In a machine as defined in claim 1, the duplicator machine being a xerographic duplicator including charging means for charging a chargeable surface, illuminating means illuminating an original to be copied and correspondingly exposing the chargeable surface, means for fixing the image formed on the chargeable surface and a delivery station located at the end of the path of travel of the copies, the controllable marking means being located in the path of travel of the copies intermediate the means for fixing and the delivery station, and further including preselecting means for preselecting the routings markings to be provided on the copies by the marking means.

27. In a machine as defined in claim 1, the duplicator machine being an electrostatic copying machine of the type operative for forming an electrostatic latent image on electrostatically chargeable copying paper, converting the latent image into a powder image, and then fixing the powder image, and including a delivery station at the end of the path of travel of the copies through the duplicator machine, the controllable marking means being arranged in the path of travel of the copies intermediate the location at which the powder image is fixed and the delivery station, and further including means for preselecting the routing markings which the marking means provides on the copies to be made.

28. In a machine as defined in claim 1, the duplicator machine including means for holding originals and masks for predetermined movement relative to each other for the making of copies of the images on selected portions of originals, printing forms, and the like, and a delivery station at the end of the path of travel of the copies travelling through the machine, the controllable marking means being located upstream of the delivery station in the path of travel of the copies travelling through the duplicator machine.

29. In a machine as defined in claim 1, the printing cylinders being arranged side by side in a row extending transverse to the direction of travel of copies travelling through the duplicator machine.

* * * * *